US007231984B2

(12) United States Patent
Jaensch

(10) Patent No.: US 7,231,984 B2
(45) Date of Patent: Jun. 19, 2007

(54) GRIPPING INSERT AND METHOD OF GRIPPING A TUBULAR

(75) Inventor: Manfred Jaensch, Garbsen (DE)

(73) Assignee: Weatherford/Lamb, Inc., Houston, TX (US)

( * ) Notice: Subject to any disclaimer, the term of this patent is extended or adjusted under 35 U.S.C. 154(b) by 124 days.

(21) Appl. No.: 10/787,846

(22) Filed: Feb. 26, 2004

(65) Prior Publication Data

US 2004/0194967 A1 Oct. 7, 2004

Related U.S. Application Data

(60) Provisional application No. 60/450,426, filed on Feb. 27, 2003, provisional application No. 60/490,555, filed on Jul. 28, 2003.

(51) Int. Cl.
*E21B 19/10* (2006.01)

(52) U.S. Cl. ..... 166/380; 160/85.1; 160/77.51; 175/423; 254/29 R; 81/421

(58) Field of Classification Search ..... 166/77.1, 166/77.51, 85.1, 78.1, 380; 175/423; 254/29 R; 294/902; 279/152; 81/186, 421–426.5, 81/185.1, 57.5; 269/271, 273
See application file for complete search history.

(56) References Cited

U.S. PATENT DOCUMENTS

| | | | |
|---|---|---|---|
| 1,650,101 | A | 11/1927 | Taylor |
| 1,719,533 | A | 7/1929 | Cady |
| 1,836,680 | A | 12/1931 | Nixon |
| 1,838,439 | A | 12/1931 | O'Brien |
| 2,184,231 | A | 12/1939 | Allen |
| 2,287,432 | A | 6/1942 | Kinzbach |
| 2,493,556 | A | 1/1950 | Stone |
| 2,765,000 | A | 10/1956 | Bond |
| 2,793,136 | A | 5/1957 | Root |

(Continued)

FOREIGN PATENT DOCUMENTS

| | | |
|---|---|---|
| DE | 705856 | 4/1941 |

(Continued)

OTHER PUBLICATIONS

EP Search Report, Application No. EP 04 25 1127, dated Jan. 27, 2005.

(Continued)

*Primary Examiner*—David Bagnell
*Assistant Examiner*—Matthew J. Smith
(74) *Attorney, Agent, or Firm*—Patterson & Sheridan, L.L.P.

(57) ABSTRACT

The present invention generally provides an insert for a clamping device or gripping apparatus for conducting translational forces and/or torque into a moveable object, such as a tubular, casing, liner, pipe, expandable tubular, tubing, drill pipe. In one aspect, the insert comprises a base material and a plurality of gripping elements forming an object gripping surface. Gripping elements are at least partially embedded in the base material. The gripping elements in one embodiment are curved to correspond to an outer circumference of an object to be gripped. In one embodiment, the gripping elements are inclined relative to a longitudinal axis of the insert. In another aspect, the gripping elements may comprise grains or particles of a hardened or super-hard material. The present invention also provides a method of making the insert and using the insert in a gripping apparatus.

71 Claims, 6 Drawing Sheets

U.S. PATENT DOCUMENTS

| | | | | |
|---|---|---|---|---|
| 2,830,788 | A | 4/1958 | Bentley et al. | |
| 2,870,794 | A | 1/1959 | Thaxton | |
| 2,896,292 | A | 7/1959 | Kinzbach | |
| 2,962,919 | A | 12/1960 | Grundmann et al. | |
| 3,015,142 | A | 1/1962 | Rosanoff et al. | |
| 3,023,651 | A | 3/1962 | Wallace | |
| 3,122,811 | A | 3/1964 | Gilreath | |
| 3,261,241 | A | 7/1966 | Catland | |
| 3,272,038 | A | 9/1966 | Burstall | |
| 3,368,252 | A | 2/1968 | Meek, Sr. | |
| 3,371,562 | A | 3/1968 | Kelley | |
| 3,513,511 | A | 5/1970 | Crickmer | |
| 3,531,836 | A | 10/1970 | Crickmer | |
| 3,538,561 | A | 11/1970 | Anastasiu et al. | |
| 3,589,742 | A | 6/1971 | Flick | |
| 3,778,094 | A | 12/1973 | Grolet et al. | |
| 3,799,010 | A | 3/1974 | Guier | |
| 3,875,826 | A | 4/1975 | Dreyfuss et al. | |
| 4,060,014 | A | 11/1977 | Turner, Jr. | |
| 4,077,250 | A | 3/1978 | Wesch | |
| 4,084,453 | A | 4/1978 | Eckel | |
| 4,192,206 | A | 3/1980 | Schulze-Beckinghausen | |
| 4,250,773 | A | 2/1981 | Haynes et al. | |
| 4,276,771 | A | 7/1981 | Wesch, Jr. | |
| 4,281,535 | A | 8/1981 | Wesch, Jr. | |
| 4,297,922 | A | 11/1981 | Higdon | |
| 4,576,067 | A | 3/1986 | Buck | |
| 4,593,584 | A | 6/1986 | Neves | |
| 4,649,777 | A | 3/1987 | Buck | |
| 4,709,599 | A | 12/1987 | Buck | |
| 4,712,284 | A | 12/1987 | Coyle, Sr. et al. | |
| 4,836,064 | A | 6/1989 | Slator | |
| 4,869,137 | A | 9/1989 | Slator | |
| D314,896 | S | 2/1991 | Haynes | |
| 5,044,232 | A | 9/1991 | Schulze-Beckinghausen | |
| 5,167,173 | A | 12/1992 | Pietras | |
| D336,836 | S | 6/1993 | Neves | |
| 5,221,099 | A | 6/1993 | Jansch | |
| 5,451,084 | A | 9/1995 | Jansch | |
| 5,971,086 | A * | 10/1999 | Bee et al. | 175/423 |
| 6,079,509 | A | 6/2000 | Bee et al. | |
| 6,311,792 | B1 | 11/2001 | Scott et al. | |
| 6,755,097 | B2 * | 6/2004 | Bangert | 81/57.5 |
| 2001/0042625 | A1 | 11/2001 | Appleton | |
| 2002/0121160 | A1 | 9/2002 | Bangert | |

FOREIGN PATENT DOCUMENTS

| | | |
|---|---|---|
| DE | 806426 | 1/1952 |
| EP | 0 656 986 | 9/1996 |
| FR | 319875 | 1/1954 |
| GB | 489305 | 7/1938 |
| GB | 1 468456 | 3/1977 |
| GB | 2 011 028 | 7/1979 |
| GB | 2 085 782 | 5/1982 |
| GB | 2386623 | 9/2003 |
| WO | WO 91/00377 | 1/1991 |
| WO | WO 94/05894 | 3/1994 |

OTHER PUBLICATIONS

EP Search Report, Application No.: 04 251 127.9, Dated May 29, 2006.

GB Search Report, Application No.: GB 0518159.9, Dated May 30, 2006.

* cited by examiner

FIG. 5
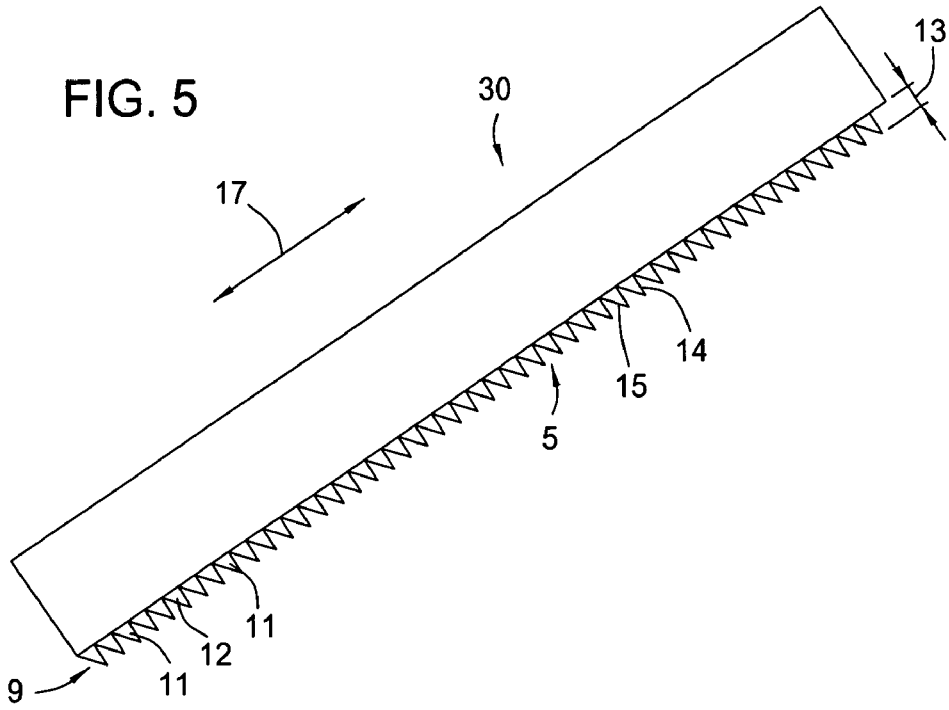
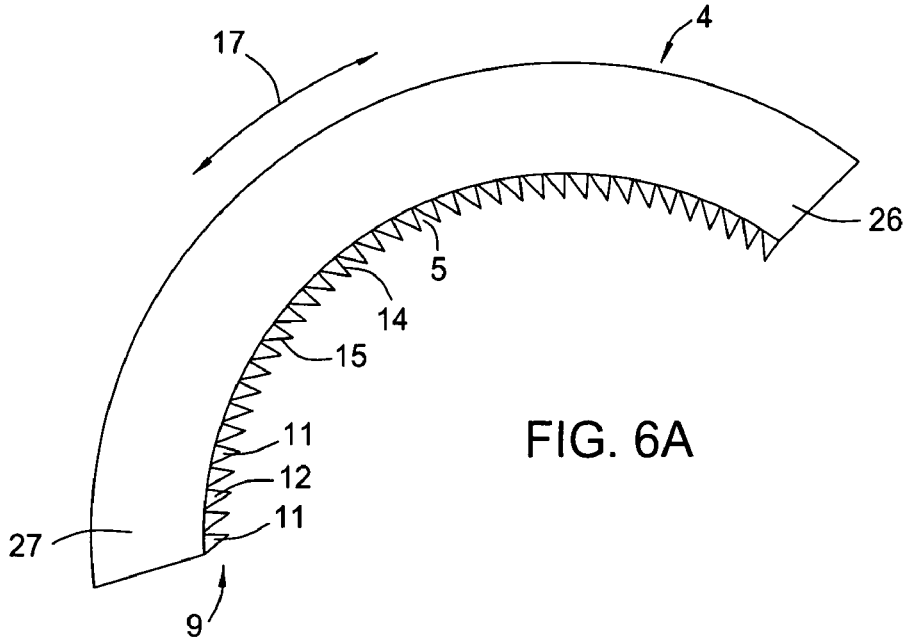
FIG. 6A
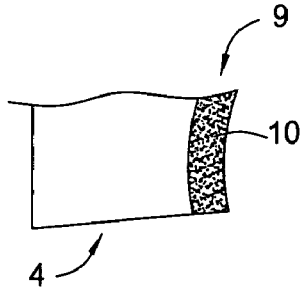
FIG. 7

GRIPPING INSERT AND METHOD OF GRIPPING A TUBULAR

CROSS-REFERENCE TO RELATED APPLICATIONS

This application claims benefit of U.S. Provisional Patent Application Ser. No. 60/450,426 entitled "Insert for Clamping Device", filed Feb. 27, 2003, which application is herein incorporated by reference in its entirety. This application further claims benefit of U.S. Provisional Patent Application Ser. No. 60/490,555 entitled "Insert for Gripping Apparatus", filed Jul. 28, 2003, which application is herein incorporated by reference in its entirety.

BACKGROUND OF THE INVENTION

1. Field of the Invention

Embodiments of the invention relate to an insert for a clamping device or gripping apparatus, which is used in particular in the field of oil and gas exploration, wherein such a clamping device or gripping apparatus conducts translational forces and/or torques into a moveable object. Such a moveable object can be a tubular body, including casing, drill pipe, etc. Lengths or stands are added to or detached from such casing or drill pipe strings, for example, during well drilling.

2. Description of the Related Art

In conventional well completion operations, a wellbore is formed to access hydrocarbon-bearing formations by the use of drilling. To drill within the wellbore to a predetermined depth, a drill string having a cutting structure attached to its lower end is often rotated by a top drive or rotary table. After drilling to a predetermined depth, the drill string and drill bit are removed and a section of casing is lowered into the wellbore.

Often, it is necessary to conduct a pipe handling operation to connect joints of casing to form casing strings which extend to the drilled depth. Pipe handling operations require the connection of casing joints to one another to line the wellbore and to form a barrier to the surrounding wellbore. To threadedly connect the casing joints, the casing string must be suspended above the wellbore so that each casing string is disposed coaxially with a casing string previously disposed within the wellbore. The threaded connection must be made up by a device which imparts torque to one casing joint relative to the others, such as a tong or a top drive. The casing string formed of the casing joints is then lowered into the previously drilled wellbore.

It is common to employ more than one string of casing in a wellbore. In this respect, the well is drilled to a first designated depth with a drill bit on a drill string. The drill string is removed. Sections of casing are connected to one another and lowered into the wellbore using the pipe handling operation described above to form a first string of casing longitudinally fixed in the drilled out portion of the wellbore. Next, the well is drilled to a second designated depth through the first casing string, and a second, smaller diameter string of casing comprising casing sections is hung off of the first string of casing. This process is typically repeated with additional casing strings until the well has been drilled to total depth. In this manner, wellbores are typically formed with two or more strings of casing.

As an alternative to the conventional method, drilling with casing is a method often used to place casing strings within the wellbore. This method involves attaching a cutting structure in the form of a drill bit to the lower end of the same string of casing which will line the wellbore. Drilling with casing is often the preferred method of well completion because only one run-in of the working string into the wellbore is necessary to form and line the wellbore for each casing string.

Drilling with casing is typically accomplished using a top drive powered by a motor because the top drive is capable of performing both functions of imparting torque to the casing string to make up the connection between casing strings during pipe handling operations and of drilling the casing string into the formation. Often, the top drive is connected to a gripping head, which is an external gripping device such as a torque head or an internal gripping device such as a spear. An exemplary torque head is disclosed in U.S. Pat. No. 6,311,792 B1, issued on Nov. 6, 2001 to Scott et al., which is herein incorporated by reference in its entirety. An exemplary spear is disclosed in U.S. patent application Publication No. US 2001/0042625 A1, filed by Appleton on Jul. 30, 2001, which is also incorporated by reference in its entirety. The gripping head has a longitudinal bore therethrough through which fluid may flow and grippingly engages the casing string to serve as a load path to transmit the full torque applied from the top drive to the casing string.

In conventional drilling operations as well as drilling with casing operations, drill strings, pipes, and casings, including corresponding pipes or casings connected during the pipe handling operation, are held, torqued, and/or translated by tongs, spiders, elevators, and gripping heads such as torque heads and spears during different stages of a well completion or other wellbore operation. Spiders and elevators are utilized to grippingly engage tubulars, pipes, drill strings, and/or casing strings above the wellbore. A spider is disposed at the surface of the well or at or in a rig floor when utilizing a drilling rig, while an elevator is suspended by bails above the surface of the well to maintain the tubulars, pipes, drill strings, and/or casing strings above the surface of the well during various operations. The spider is used to maintain a tubular, pipe, drill string, or casing string at the surface of the well and prevent it from slipping further into the drilled-out wellbore.

All of the above gripping apparatus may hold pipes, tubulars, drill strings, or casings by means of jaws disposed in these devices. These jaws may have inserts that are interchangeable and conduct translational forces and/or torques into corresponding moveable objects. Such an insert typically comprises a base material and gripping elements. Each gripping element has an object gripping surface with which it engages the corresponding object in order to lift, shift, or rotate the object. In particular, for rotation of the object, considerable clamping or gripping forces are necessary to transmit torque. The corresponding gripping elements are at least partially embedded in the base material and may be fixed within the base material during vulcanization.

A prior art clamping device includes strip-like gripping elements extending parallel with the longitudinal axis of the object to be gripped. Such inserts are sufficient for lifting or holding corresponding objects. However, if these inserts are used for rotating the object, it is possible that the corresponding gripping elements may tilt away under heavy load produced while transmitting torque to the object. Moreover, such inserts can cause undesired indentations or markings on the surface of the object to be clamped such that this surface undergoes increased corrosion. These indentations and markings are, in particular, caused during starting of the rotation when the clamping power has to be increased to stop relative movement between the jaws and the object being clamped.

Prior art gripping apparatuses cause scarring and/or marking of the object being grippingly engaged when imparting torque to the object. The scarring and/or marking increases damage to the object, thus possibly impairing the effectiveness of the object in the well operations and increasing the incidence of failure of the pipe, e.g., casing or other tubular body, within the wellbore. Additionally, the scarring and/or marking may increase corrosion along the pipe's surfaces.

There is a need, therefore, for an insert for a clamping device with which it is possible to transmit a higher torque, even when having a small gripping area, and leaving fewer indentations or markings on the surface of an object to be clamped. There is also a need for a gripping apparatus which minimizes damage to an object being grippingly engaged, even while maintaining the effectiveness of the frictional engagement with the object, and even while imparting torque to or linearly translating the object.

SUMMARY OF THE INVENTION

The present invention provides an insert for a clamping device for conducting translational forces and/or torque into a moveable object. The object may be a tubular body such as a joint of casing, or it may be a non-tubular object such as a square device. In one embodiment, the insert comprises a base material having a plurality of strip-like gripping elements at least partially embedded into the base material. Each gripping element employs an object gripping surface. The gripping elements are configured to correspond to an outer shape of the object being gripped. The strip-like gripping elements are preferably substantially parallel to one another, and are arranged transverse to a longitudinal axis of the insert. The angle of the gripping elements relative to the longitudinal axis of the insert may be optionally be offset so that the gripping elements are inclined relative to a longitudinal axis of the pipe during gripping.

In another aspect, the present invention provides an insert for a gripping apparatus for conducting translational forces and/or torque into a tubular object. The insert comprises a base material having an arcuate shape, and a gripping surface corresponding to a circumference of the tubular object. A plurality of engagement elements is attached to the gripping surface, the engagement elements capable of grippingly engaging the surface of the tubular object. In one embodiment, the engagement elements comprise grains or particles of a hardened or a super-hard material.

The present invention also provides a method of making an insert for a gripping apparatus. In one aspect, the method comprises providing a base material insertable into a housing within the gripping apparatus; and attaching engagement elements to a gripping surface of the base material. The engagement elements may comprise grains or particles of a hardened or a super-hard material capable of grippingly engaging a tubular object.

The present invention also provides a method of grippingly engaging a tubular body to impart translational forces and/or torque to the tubular body. In one embodiment, the method comprises the steps of providing a base material insertable into a housing within a gripping apparatus; attaching engagement elements to a gripping surface of the base material, the engagement elements comprising grains or particles of hard or super-hard material; inserting the base material with engagement elements attached thereto into the gripping apparatus; and grippingly engaging the tubular body with the gripping surface to impart translational forces or torque into the tubular body.

In a yet further aspect, the present invention involves a gripping apparatus for grippingly engaging a tubular object and imparting torque or translational forces to the tubular object. The apparatus in one arrangement first comprises a housing for an insert. The housing has a cavity therein formed by back and side walls. An insert is disposed within the cavity, the insert comprising a malleable base material having a hardness less than the hardness of steel. Engagement elements are attached to a gripping surface of the base material. The engagement elements may comprise particles or grains of a hard or super-hard material.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

FIG. 5 is a top view of a gripping element, in one embodiment. In this arrangement, the gripping element is linear. Alternatively, the gripping element may represent an arcuate gripping element prior to forging or reshaping.

FIG. 6A is a top view of an arcuate gripping element according to one aspect of the invention. The gripping element may represent the gripping element of FIG. 5, after reshaping.

FIG. 7 is a partially cut view corresponding to FIG. 6 of a second embodiment of a gripping element.

DETAILED DESCRIPTION OF THE PREFERRED EMBODIMENT

As used below, "clamping device" and "gripping apparatus" both represent apparatus which grippingly engage moveable objects. In addition, the clamping device or gripping apparatus may conduct translational forces and/or torques into the moveable objects. Exemplary clamping devices or gripping apparatus include elevators, spiders, tongs, torque heads, and spears. An example of a clamping device usable with the present invention is described in U.S. Pat. No. 5,451,084, which is incorporated by reference herein in its entirety. Moveable objects include, but are not limited to, tubular bodies, including casing strings, pipes, drill pipes, liners, tubing, expandable tubulars, and other tubulars.

Figure 1:
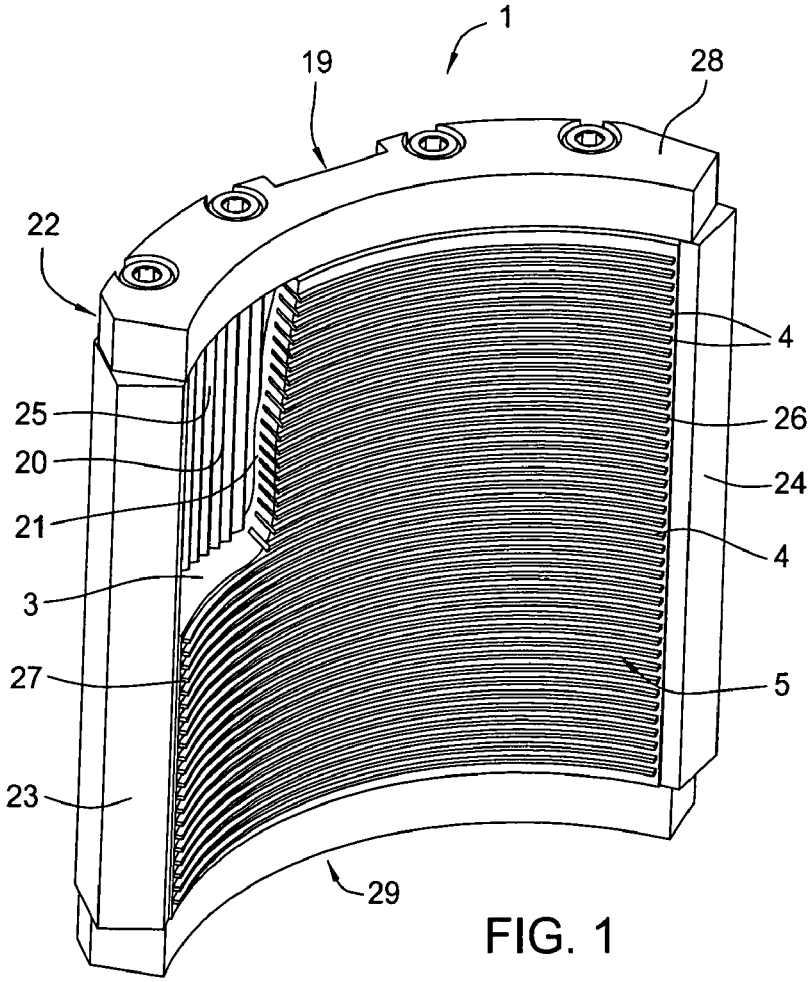
FIG. 1 is a side elevational view of one embodiment of an insert used for a clamping device or gripping apparatus.
Figure 2:
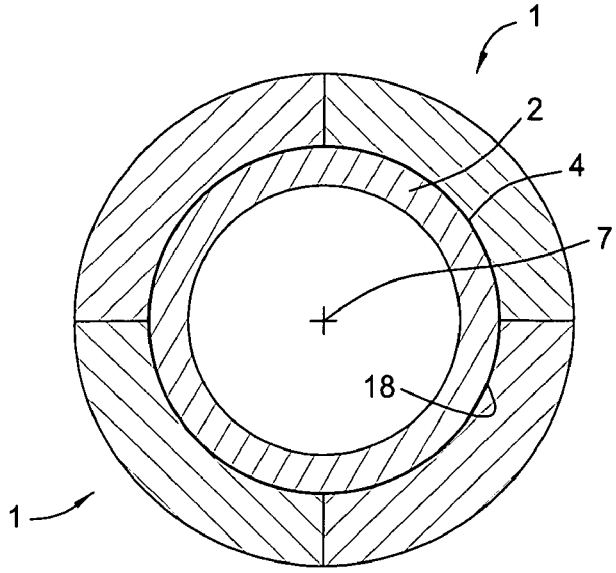
FIG. 2 is a downward cross-sectional view of four inserts arranged around a tubular object.

FIG. 1 is a side elevational view of a first embodiment of an insert 1. FIG. 2 is a downward cross-sectional view of four inserts 1 arranged around a tubular object. The insert 1 is configured to apply frictional force against a corresponding moveable object, such as the tubular object 2 in FIG. 2. The insert 1 is designed to operate within a jaw of a clamping device or gripping apparatus (not shown), such as a tong, spider, gripping head, or elevator. One or more inserts 1 as shown in FIG. 1 are utilized around the object 2 in connection with a gripping apparatus. When using multiple inserts 1, the inserts 1 are preferably arranged in a circular manner to surround the object 2, and the inserts 1 may be stacked upon one another as desired. The different inserts 1 may be arranged within an adaptor or the like with two or more of these inserts 1 arranged around the object 2 and with as many of such groups of two or more inserts 1 stacked above each other as necessary. For example, four inserts 1 may be utilized as shown in FIG. 2.

Figure 3:
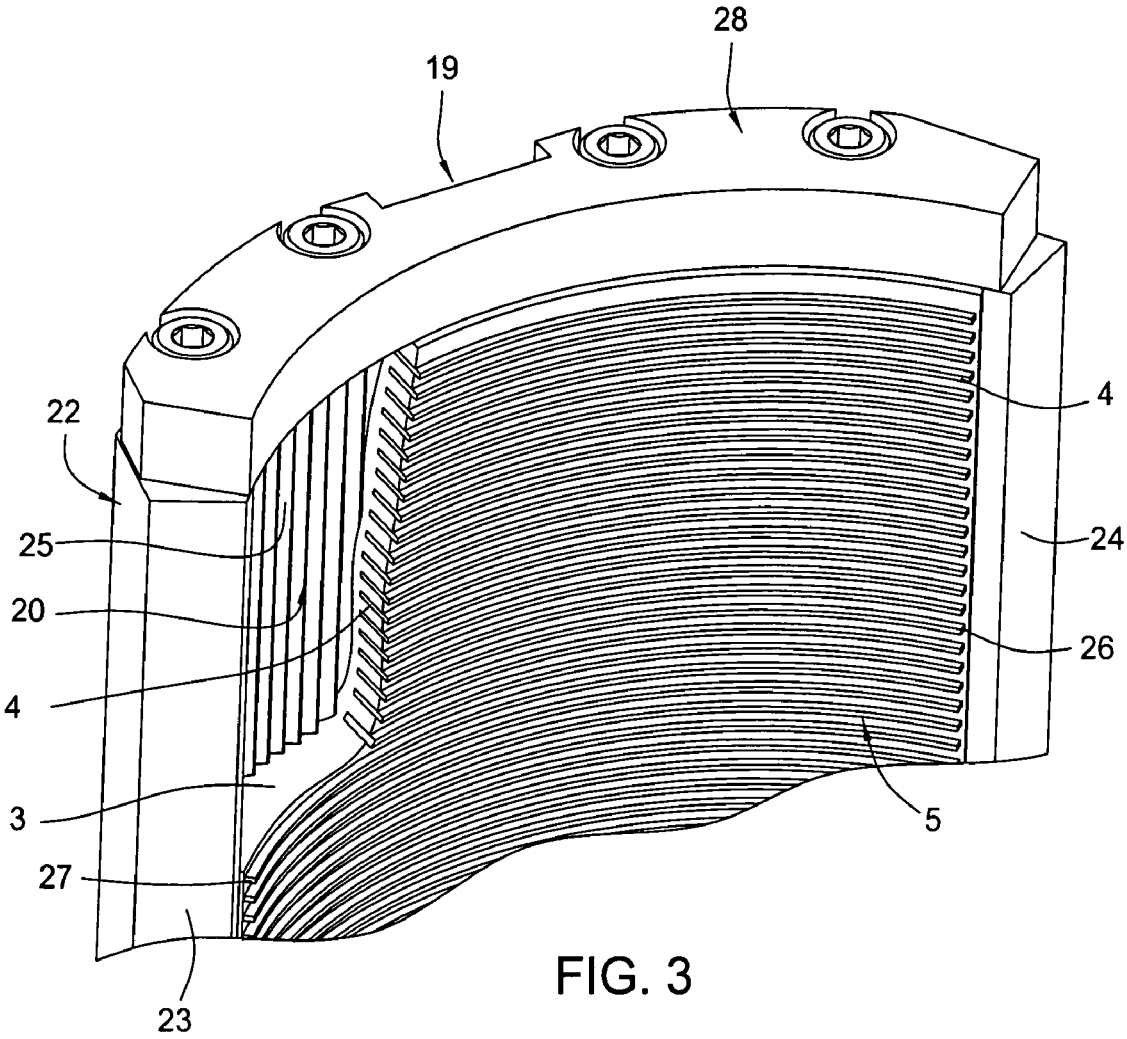
FIG. 3 is an enlarged section view of FIG. 1.

FIG. 3 is an enlarged section view of FIG. 1. Features of the insert 1 are more clearly seen in FIG. 3. As can be seen in FIGS. 1 and 3, the insert 1 employs a plurality of gripping elements 4 disposed along a base material 3. The base material 3 is fabricated from a material that has a certain elasticity. Examples include a soft metal such as aluminum, and an elastomeric lining such as a rubber matrix. In the arrangement of FIGS. 1 and 3, the gripping elements are strip-like in configuration, and are embedded within the base material 3. Thus, the plurality of strip-like gripping elements serve as "gripping bars" 4. These gripping elements 4 are preferably constructed of a hard material and are preferably of a metal material with an object gripping surface 5 (see FIGS. 4 and 6) protruding from the base material 3 in the direction of the object 2 to be held (see FIG. 2). The base material 3 and gripping elements 4 together form an engagement surface 5 for engaging the circumference 18 of an object, such as the tubular of FIG. 2. The engagement surface 5 may be flush with the surface of the base material 3 or may even be arranged partially or completely within the base material 3.

The plurality of gripping elements 4 are preferably curved or rounded so that the curvature of the gripping elements 4 substantially corresponds to the curvature of the circumference of the object 2, such as the tubular object shown in FIG. 2. Preferably, the different gripping elements 4 are arranged substantially parallel to each other (see FIGS. 1 and 3) and preferably with a constant distance between neighboring gripping elements 4. In one embodiment, the gripping elements 4 are arranged at an angle 8 (see FIG. 4) of approximately 90° with respect to the longitudinal axis of the insert 1. In this way, the gripping elements are also oriented transverse to a longitudinal axis 7 of the object 2 (see FIG. 2) being gripped.

In the arrangement of FIGS. 1 and 3, the insert 1 includes an insert housing 19. The housing has a back wall 22, side walls 23 and 24, and top and bottom walls 28 and 29. By these walls 22, 23, 24, 28, and 29, a concave cavity 20 is formed in which base material 3 is insertable. First and second ends 26, 27 of each gripping element 4 are supported by the side walls 23, 24 of the housing 19 such that the forces introduced into the gripping element 4 by transferring torque to an object, e.g., tubular body 2, are distributed in a lengthwise direction 17 (see FIGS. 5 and 6) relative to the gripping element 4. By the corresponding curvature of the gripping elements 4 relative to the curvature of the object 2, and also by the elasticity of the base member 3, a substantially full surface-to-surface contact between the object gripping surface 5 and the outer surface or circumference of object 2 is rendered possible, even if the surface to be engaged deviates from, for example, a cylindrical shape, or even if the surface to be engaged has unevenness of curvature, i.e., is "out of round."

To prevent displacement of the gripping element 4 in a lengthwise direction as much as possible, ribs 25 are optionally arranged on an inner surface 21 of the back wall 22 of the insert 1. The ribs 25 preferably extend perpendicular to the lengthwise direction of the gripping elements 4 and parallel to the longitudinal axis 7 of object 2.

The base material 3 is held in the cavity 20 at its upper and lower ends by the top and bottom walls 28 and 29 of the insert housing 19 These walls 28 and 29 are preferably releasably attached to the back wall 22 of the insert housing 19. The depth of cavity 20 is preferably generally smaller than the thickness of the base material 3 such that the base material 3 protrudes from the cavity 20 in the direction of the object 2, at least with its gripping elements 4. By this relation of depth and thickness, any contact of walls 23, 24, 28, and 29 with the outer surface of object 2 is avoided.

Referring again to FIG. 2, FIG. 2 provides a downward cross-sectional view of four inserts 1 arranged around a tubular object 2 with longitudinal axis 7. The inserts 1 with the corresponding gripping elements 4 (see FIG. 1) are shown in full surface-to-surface contact with circumference 18 or outer surface of object 2. The surface-to-surface contact does not have to be full, but may merely be substantial enough to effectively grippingly engage the object 2, so that the insert 1 possesses the ability to provide torque and/or translational force to the object 2. It is also possible to arrange more than two inserts 1 around object 2. In one embodiment, only three inserts 1 are used.

Figure 4:
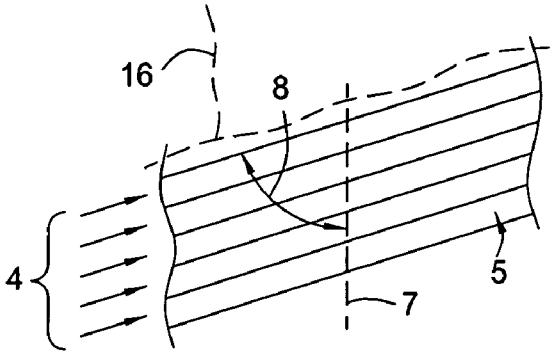
FIG. 4 provides a principle view of a number of gripping elements inclined with respect to longitudinal axis of tubular.

In FIG. 4, a second embodiment of the invention is illustrated. In this embodiment, the gripping elements 4 are arranged at an angle 8 different than 90° with respect to longitudinal axis 7 of the insert 1. The angle 8 may be in the range of, for example, about 50° to 130°, about 70° to 110°, or about 85° to 95°.

In another embodiment of a gripping element, shown by the dotted line in FIG. 4 at "16," the gripping element may have a wave-like curvature such that the gripping element 16 is substantially sinusoidal in lengthwise direction 17.

Figure 6B:
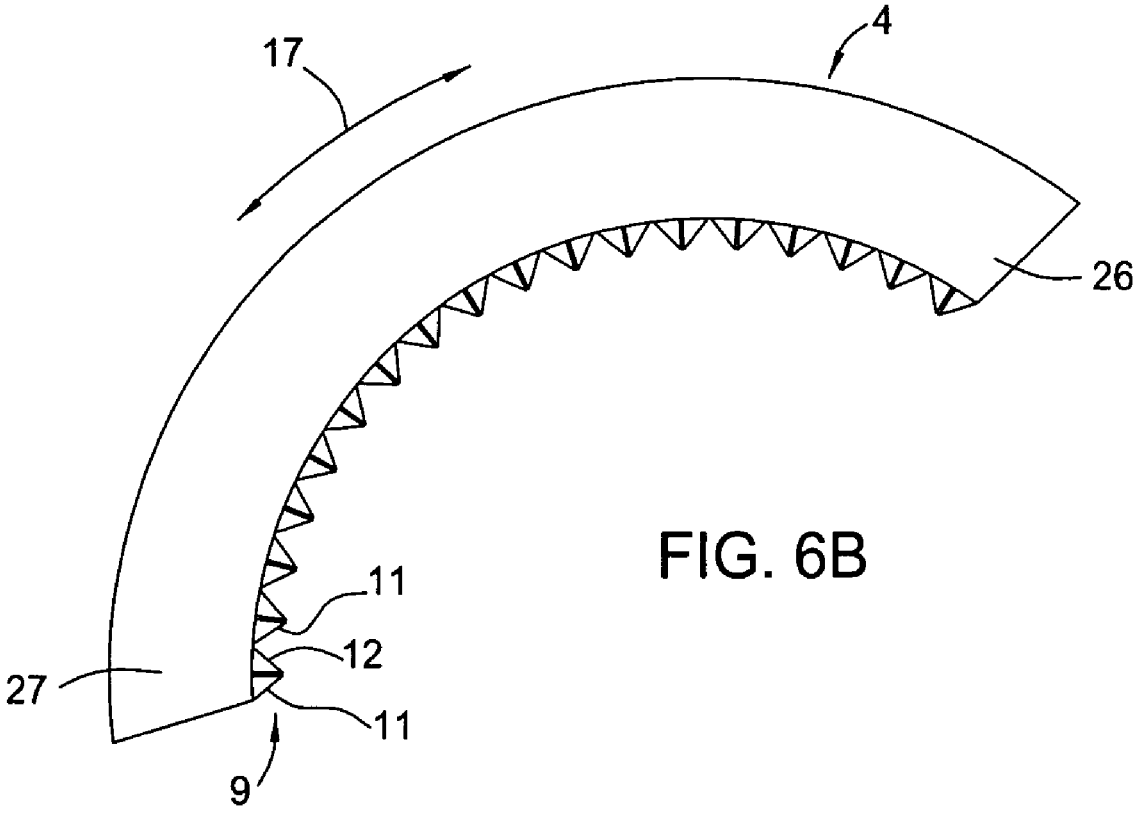
FIG. 6B is a top view of an arcuate gripping element according to another aspect of the invention.

FIGS. 5 to 7 illustrate different embodiments of the gripping element 4. In FIGS. 5 and 6A, teeth 11, 12 are used as gripping elements 9, while in FIG. 7, grains or particles 10 are used as gripping elements 9. In FIG. 5, a top view of a gripping element 30 is shown. In this arrangement, the gripping element is not curved, as in other embodiments, but is essentially linear. Alternatively, the gripping element 30 may represent an arcuate gripping element prior to forging or reshaping. The gripping element has a plurality of teeth 11, 12 on the object gripping surface 5. The exemplary teeth 11, 12 are arranged linearly. Optionally, the linearly arranged teeth 11 and 12 may be staggered so that a row of teeth 11 are at a different angle of orientation to a row of teeth 12 (see FIG. 6B). In this way, the teeth 11, 12 are interlaced with respect to each other.

The different teeth 11, 12 may have the same depth 13 according to the illustrated embodiment. Also, leading and trailing edges 14, 15 of the teeth 11, 12, may have the same angles with respect to lengthwise direction 17, as illustrated. In the alternative, the depth may be different between pairs of teeth 11, 12 or between a group of three, four, or more consecutive teeth 11, 12, with such groups or pairs repeating in lengthwise direction 17. The same is true for the angles of leading and trailing faces 14, 15 of the teeth 11, 12, which may alternate within repeating groups.

By casting or forging, the original gripping element 30 of FIG. 5 can be reshaped to form the curved gripping element 4 of FIG. 6A. The gripping element 4 may have a curvature selected to substantially conform to the corresponding curvature of housing 19 and/or an object to be gripped, such as object 2 of FIG. 2. In the embodiment shown in FIG. 6, the gripping element 4 has a constant radius of curvature. The arrangement of the teeth 11, 12 is shown in FIG. 6A as the same arrangement shown in FIG. 5, but the teeth 11, 12 may be arranged at different angles with respect to each other as mentioned above and shown in FIG. 6B. The curved gripping element 4 with first and second ends 26, 27 is then partially or completely embedded in base material 3 by vulcanization or similar process, and then the insert 1 with the plurality of gripping elements 4 is inserted in cavity 20 (see FIGS. 1 and 3).

In FIG. 7, an additional embodiment of the gripping element 4 is partly illustrated, wherein instead of fabricating teeth 11, 12, grains or particles 10 are used as engagement elements 9. These grains or particles are at least partially embedded in the object gripping surface 5 of gripping element 4 and will engage the outer surface of the object 2 (see FIG. 2) for transferring torque and/or translational force thereto.

According to the embodiments of the invention shown and described above with respect to FIGS. 1–7, an insert 1 is provided for a clamping device or gripping apparatus (not shown) comprising one or more gripping elements, 30 that are arcuate or curved, corresponding to the outer shape of the object 2 to be gripped. The gripping elements 4 may be inclined, at least slightly, relative to a longitudinal axis 7 of the insert 1. Due to the curvature of the gripping elements, there is a close surface-to-surface contact between the object gripping surface 9 and the outer surface 18 of the object 2. This curvature and the inclined arrangement of the gripping elements relative to the longitudinal axis 7 of the insert 1 allow transfer of high torques and/or translational forces to the moveable object 2 with a reduced gripping area, while reducing indentations or markings.

The inclination of the gripping elements 4 relative to the insert 1 can be realized by arranging the gripping elements 4 relative to the longitudinal axis 7 of the object 2 at an angle 8 in the range of about 50° –130°. In such a way, the gripping elements 4 surround the object 2 like a helix. If transmitting higher torque to the object 2, the angle 8 may be smaller and is preferably in the range of about 70° –110°. Generally, the highest torque can transferred to the object 2 or tubular if this angle 8 is about 90°. However, the angle 8 also depends on the relative arrangement of, for example, teeth 11, 12 with respect to the gripping element 4. The teeth 11, 12 may have blade-like tips that extend relative to the lengthwise direction of the gripping element 4 at an angle 8 different than 90° or less than 90°. In such a case, it may be advantageous to arrange, for example, the gripping elements 4 relative to the object 2 at an angle 8 of about 100° or an angle of less than 100° in case those blade-like tips are arranged relative to the gripping element 4 at an angle 8 of about 80° or an angle of less than 80°. However, a variety of angles 8 may be used in this respect and the combination just outlined may be particularly suitable but the invention is not limited to such combinations.

According to an embodiment of the present invention, the different gripping elements 4, 30 of one insert 1 are displaced with respect to each other in the lengthwise direction of the gripping elements 4, 30. According to another embodiment of the present invention, the angle of inclination is different from one gripping element 4, 30 to the other or for different groups of gripping elements 4, 30. To simplify the design and to reduce costs, the gripping elements 4 may be arranged parallel to each other.

If the surface of the object 2 to be engaged deviates from a regular shape or has, for example, unevenness in curvature, the base material 3 can have an elasticity which permits compensation for deviations or unevenness of curvature. An example of such a base material 3 with an elasticity is an elastomeric lining or rubber matrix. By using such a base material 3 with elasticity, it is possible to ensure there is a consistent engagement between the gripping surface 5, 9 and the surface of the object 2 or tubular. In one embodiment, the gripping surface 5, 9 of the gripping element 4, 30 is flush with the surface of the base material 3. In another embodiment, the gripping surface 5, 9 protrudes from this surface to the object 2.

Gripping elements 4, 30 that are easily arrangeable within the base material 3 and which are also of simple and inexpensive designs are blade or bar-like with engagement elements 9 on the gripping surface 5, as shown in FIG. 7. In some instances, it may be advantageous to form the engagement elements 9 of a harder material than the rest of the gripping elements 4, 30. One possibility in this respect is engagement elements 9 which are grain or particle-like 10 and are made of at least one material selected from the group comprising: titanium, diamond, glass, ceramics, corundum, or quartz. These grains or particles 10 can be embedded in the object gripping surface 5, 9 and may partially protrude above this surface 5, 9 thereof.

Because the base material 3 is elastic, it is also possible that the curvature of the gripping element 4, 30 is initially different than the curvature of the outer surface 18 of the object 2. The different curvatures are then adapted to each other by the elasticity of the base material 3 such that at least substantially full surface-to-surface contact between object gripping surface 5, 9 and outer surface 18 of the object 2 is obtained. It is, of course, also possible that the curvature of the gripping element 4, 30 is complementary to the curvature of the object 2. The gripping elements 4, 30 may have a constant radius of curvature wherein they are shaped like a circle, or in the alternative, the radius of curvature may change along a lengthwise direction of the gripping element 4, 30 or in a circumferential direction of the object 2. In this manner the elasticity of the base material 3 compensates for misalignments, and the insert 1 can, in some instances, be designed to initially be misaligned but to then place additional force on a certain area of the object 2 or tubular as the elastic base material 3 is reformed during the gripping operation.

Instead of grains or particles 10 as engagement elements 9, it is also possible to use a plurality of teeth 11, 12 on the object gripping surface 5. To simplify the design of such engagement elements 9, all teeth 11, 12 may have the same depth 13 and same angles of leading and trailing faces 14, 15.

To hold the object 2 in more than one plane corresponding to the extension of the gripping element 4, the teeth 11, 12 may be interlaced. One possibility is that every second tooth 11, 12 is interlaced with respect to the other teeth 11, 12 or that in a group of three teeth 11, 12, the second and third teeth 11, 12 are interlaced with respect to the first tooth 11, 12 and are also interlaced relative to each other. Of course, there are more possible combinations of interlaced teeth 11, 12.

Another design possibility to permit clamping the object 2 in more than one plane corresponding to the lengthwise direction of the insert 1 is to provide a gripping element 16 with a wave-like curvature in its lengthwise direction, as discussed above. Such a wave-like curvature is, for example, sinusoidal. The wave-like curvatures of neighboring gripping elements 4 may thus be in phase or out of phase.

To simplify the arrangement of the inserts 1 within corresponding jaws (not shown) of the clamping device (not shown) and to facilitate the gripping of an object 2 such as a tubular body, each insert 1 may only partially surround the object 2 such that two, three, or more inserts 1 are arranged around the object 2 for holding the object 2 along its circumference 18. If the insert 1 comprises the housing 19 for releasably holding the base material 3 with gripping elements 4, the housing 19 can be fixed to corresponding jaws of tongs, spiders, elevators, torque heads, and spears, and also may be exchanged for replacement.

Because the gripping elements 4 are preferably arcuate-shaped, as described above, the housing 19 is also preferably an arcuate member with a cavity 20 formed in its inner surface for receiving the base material 3 having gripping elements 4. Curvature of the arcuate member or housing 19 preferably corresponds to the curvature of the gripping elements 4.

To securely hold the different gripping elements 4 and the base member 3, the cavity 20 is limited by the back wall 22 and side walls 23, 24, wherein a plurality of ribs 25 protruding toward the base member 3 are arranged on the back wall 22. The ribs 25 can be arranged perpendicular to the gripping elements 4 or may at least be inclined with respect to the lengthwise direction of the gripping elements 4.

According to an aspect of the invention, the forces introduced into the gripping elements 4 are mainly distributed in their lengthwise direction. To support the gripping elements 4 and to allow transmission of high force, the side walls 23, 24 may be employed as supports for first and second ends 26, 27 of each gripping element 4. To surround the cavity 20 and to further support base material 3 and gripping elements 4, the housing 19 may further comprise top and bottom walls 28, 29 limiting the cavity 20, and the top and bottom walls 28, 29 may be releasably fixed to the back wall 22.

According to a particular arrangement of the gripping elements 4, the gripping elements 4 of the present invention may be cast and/or forged out of an essentially linear gripping element 30 to obtain its curvature. The transformation may be accomplished by hot or cold forging, for example. The original gripping element 30 may have a simple design and may be inexpensive.

According to another aspect of the invention shown in FIGS. 8–11, engagement elements 160 are attached to a gripping surface 150 of a curved, malleable substrate 103 to form a gripping member 150 for insertion into a gripping apparatus. The resulting gripping member 150 has frictional characteristics to allow it to effectively grippingly engage an object such as a tubular, casing, liner, expandable tubular, pipe, or drill pipe (not shown) in order to provide torque to the object, with minimal damage to the object on the surface which is gripped. The flexible substrate 103 is preferably a metal with lower hardness than steel, so that the engagement elements allow metal-to-metal contact with the object 2 with decreased abrasiveness to the object.

Figure 8:
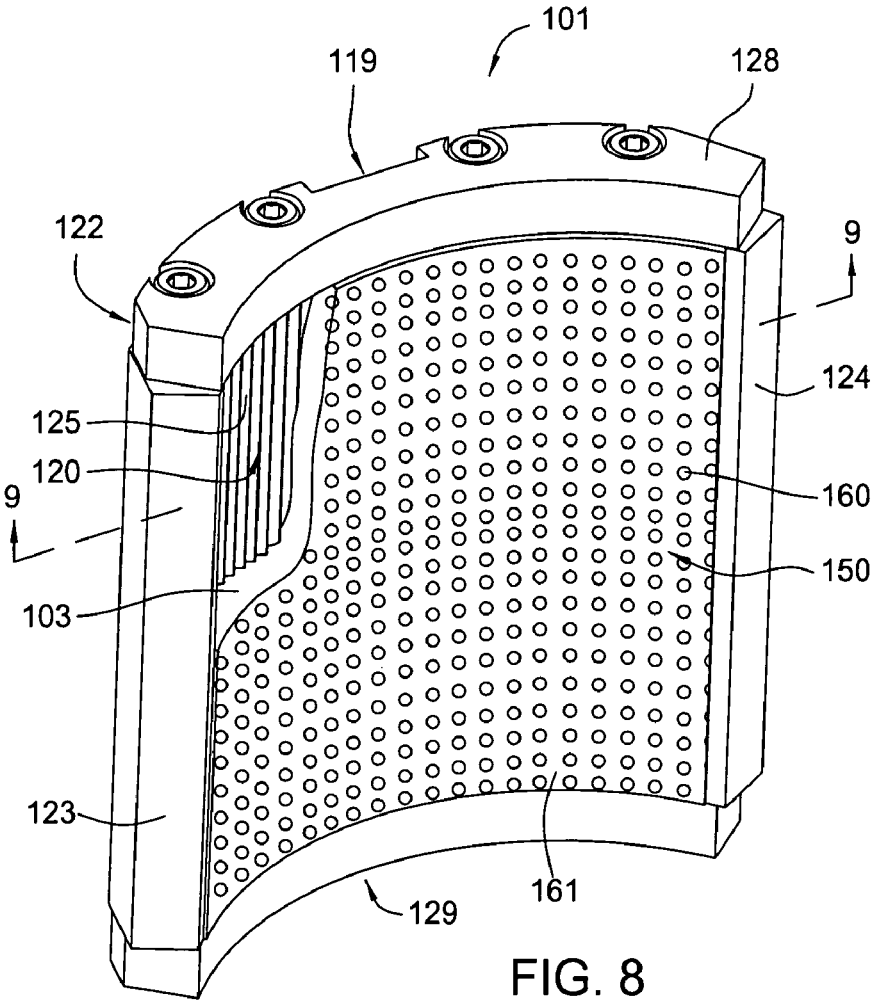
FIG. 8 is a side elevational view of another embodiment of an insert used for a clamping device or gripping apparatus.
Figure 9:
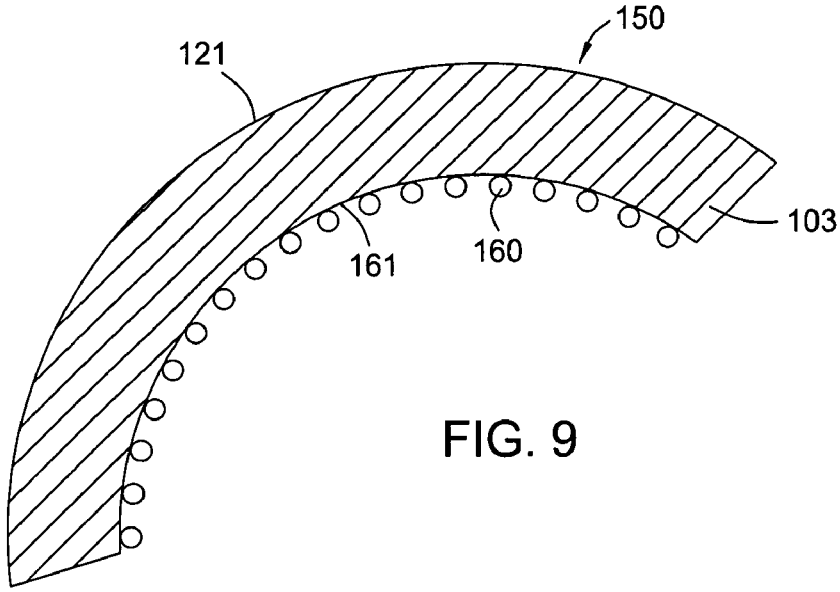
FIG. 9 is a top view of a gripping member along line 9—9 of FIG. 8.

In an alternative embodiment of the present invention shown in FIGS. 8–9, an insert 101 includes an insert housing 119 with a back wall 122, side walls 123 and 124, and top and bottom walls 128 and 129, as shown in FIG. 8. A cavity 120 is formed by the walls 122, 123, 124, 128, and 129, into which a gripping member 150 is insertable (see also FIG. 9). The top and bottom walls 128 and 129 of the insert housing 119 may be releasably fixed to the back wall 122 to facilitate replacement of the gripping member 150 when desired or needed. The gripping member 150 includes a base material 103 and engagement elements 160 thereon (see FIG. 9). The cavity 120 is preferably less in depth than the thickness of the base material 103 so that the base material 103 protrudes from the cavity 120 in the direction of an object 102 which is to be grippingly engaged (see FIG. 11) by the gripping member 150, as contact of the walls 123, 124, 128, and 129 with the outer surface of the object 102 is generally undesirable.

The base material 103 of the gripping member 150 is constructed of a flexible substrate, preferably a malleable metal of lower hardness than steel. Most preferably, the base material 103 is made of aluminum, but the base material 103 may also be made of copper or brass alloy or a combination of any of the metals. The base material 103 constructed of a malleable metal is elastic enough to allow it to conform to the object 102 to be gripped by the gripping member 150, thus permitting compensation for deviations or unevenness of curvature in the object 102 to be engaged by the gripping member 150 and providing metal-to-metal contact between the base material 103 and the object 102 being grippingly engaged. The object 102 to be held by the gripping member 150 may include, but is not limited to, casing, liners, tubing, pipe, drill pipe, expandable tubulars, or other tubulars.

Figure 11:
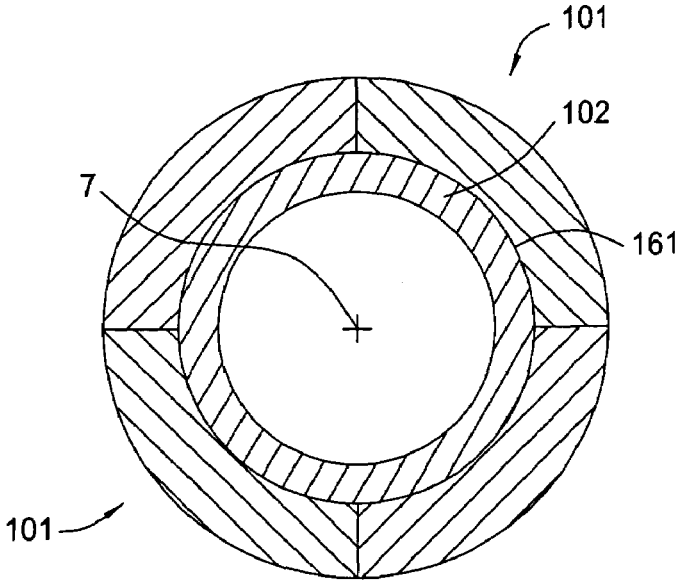
FIG. 11 is a cross-sectional view of four inserts arranged around a tubular object.

FIG. 9 shows a downward, cross-sectional view along line 9—9 of FIG. 8 of the gripping member 150. Referring primarily to FIG. 9, the base material 103 is curved into an arc which corresponds to the curvature of the outer surface of the object 102. The curvature of the base material 103 may be accomplished by, for example, casting or forging. The base material 103 may be essentially linear before the casting or forging into the arcuate shape. Because of the malleability of the base material 103, the curvature of an inner surface 161 of the base material 103 may be adapted to the curvature of the outer surface of the object 102 to be grippingly engaged by the gripping member 150 if the curvatures are initially different from one another, as shown in FIG. 11. If the object 102 to be grippingly engaged deviates from a cylindrical shape or has unevenness of curvature, the base material 103 malleability nonetheless permits gripping engagement of the object 102. In this manner, essentially complete metal-to-metal contact may be obtained between the inner surface 161 of the base material 103 and the outer surface of the object 102.

To aid in preventing vertical or horizontal displacement of the gripping member 150 relative to the insert housing 119 (see FIG. 8), ribs 125 may be arranged on an inner surface of the cavity 120 on the back wall 122, and ribs (not shown) which are at least substantially perpendicular to the ribs 125 may be arranged on an outer surface 121 (see FIG. 9) of the base material 103. Any other method of retaining the gripping member 150 within the cavity 120 is contemplated for use with the present invention.

As shown in FIGS. 8 and 9, engagement elements 160 are attached to the inner surface 161 of the base material 103, the inner surface 161 being the surface of the base material 103 directly contacting the object 102, or the gripping surface, in use. The engagement elements 160 may protrude outward toward the object 102 from the inner surface 161 of the base material 103 or may be substantially flush with the inner surface 161 of the base material 103. The engagement elements 160 may be grains, particles, fragments, or chips of a hard or super-hard material, which may include, although is not limited to, diamond dust, particles of silicon, zircon, tungsten carbide, carborundum, and mixtures thereof; cubic boron nitride, diamond, glass, ceramic, corundum, and quartz particles or grains, and mixtures thereof; thermally stable product; titanium; and polycrystalline diamond composite or natural diamond. The preferred super-hard material for use in the engagement elements 160 is diamond dust. The engagement elements 160 may be any hard or super-hard material known to those skilled in the art, including any combination of the above-listed materials.

Figure 12:
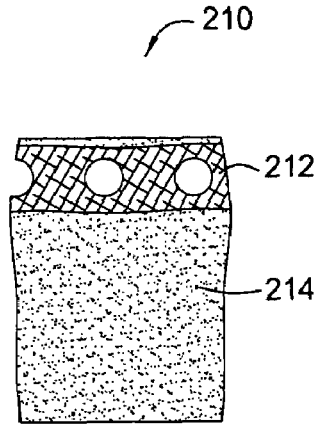
FIG. 12 is a perspective view of a strip of tape for receiving diamond dust. The diamond dust serves as the gripping element for an insert, with the tape being affixed onto the base material of the insert.

In one embodiment, a substrate of tape is provided to support diamond dust as the gripping element. A layer of copper is applied to the tape, followed by an application of the diamond dust. The tape is then affixed to a base material, such as by use of an adhesive. The base material may be either an elastomeric material or a malleable metal. FIG. 12 provides a perspective view of such a substrate of tape 210. A "cutaway" view is seen of a portion of tape 210 that includes a layer of copper 212, followed by a layer of diamond dust 214. An insert using the diamond dust 214 may be formed, in one aspect, by providing a substrate of tape 210, applying a layer of copper 212 to the tape, applying diamond dust 214 over the copper layer 212, and then affixing the tape onto the base material (not shown in FIG. 12).

Figure 10:
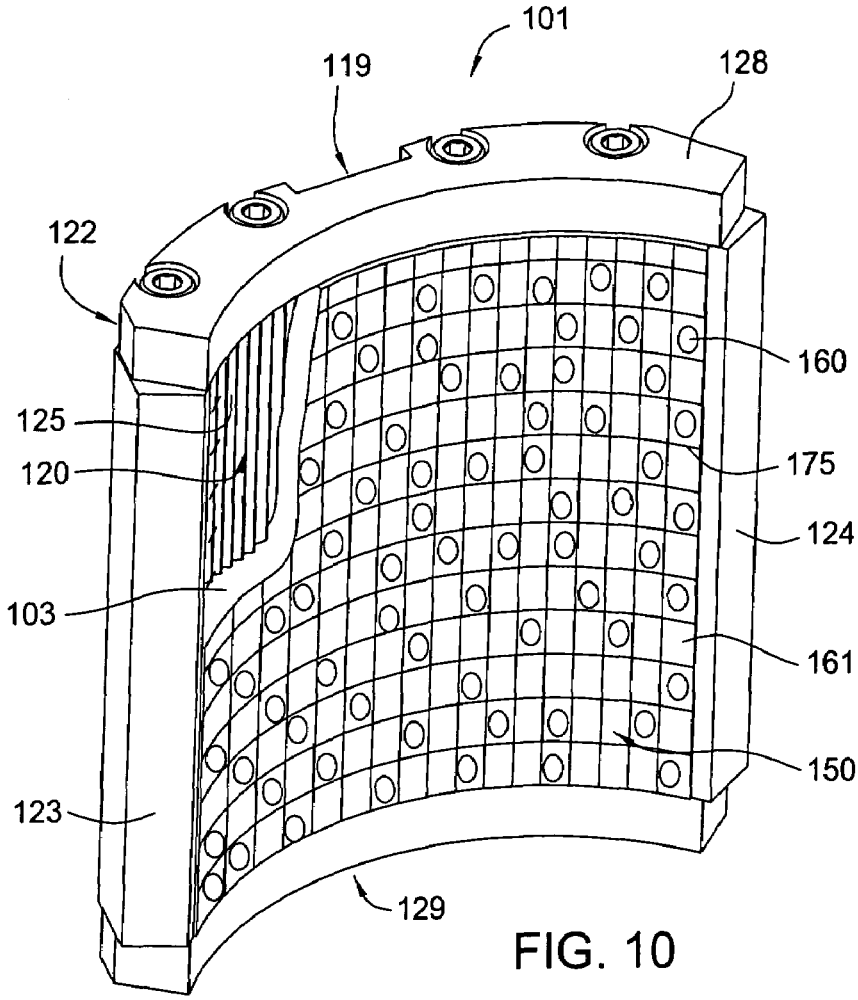
FIG. 10 is a side elevational view of an alternate embodiment of an insert according to the present invention.

The engagement elements 160 are shown in FIGS. 8–10 as substantially sphere-shaped. In the alternative, the engagement elements 160 may be cube-shaped, rectangular in shape, or of any other shape capable of grippingly engaging the object 102 when the object 102 is placed in contact with the engagement elements 160, as described below. The engagement elements 160 may be uniformly dispersed on the base material 103 or randomly dispersed, to form any pattern which allows effective gripping engagement of the object 102. Likewise, any number of engagement elements 160 which allow effective gripping engagement of the object 102 may be utilized.

Several methods of attaching the engagement elements 160 to the inner surface 161 of the base material 103 are contemplated. A first method involves welding the engagement elements 160 onto the inner surface 161 of the base material 103, then spray fusing, or flame spraying, a binding material around the engagement elements 160. The initial welding of the engagement elements 160 temporarily holds the engagement elements 160 to the inner surface 161 prior to the application of the binder material through spray fusing. The temporary attachment of the engagement elements 160 by welding allows the engagement elements 160 to be located in a specific pattern on the base material 103, the pattern subsequently maintainable through the binder process of spray fusing. Spray fusing involves applying a binding material around the engagement elements 160 to provide a permanent binding medium for the engagement elements 160 to the inner surface 161 of the base material 103. This method is suitable for use with engagement elements 160 that are hard materials, such as tungsten carbide, as these engagement elements 160 are electrically conductive and capable of spot welding.

With respect to super-hard materials such as diamond dust, which generally are not electrical conductors (but are electrical insulators), an additional step prior to the welding may be accomplished if the desired method is welding. The additional step may involve combining the engagement elements 160 with an electrically conductive component to facilitate the welding. After combining the engagement elements 160 with the electrically conductive component, the welding of the electrically conductive component may be accomplished by spot welding using electrical resistance techniques known to persons skilled in the art. The electrically conductive component may be a coating on the surface of the engagement elements 160 to be attached to the inner surface 161, including, but not limited to, nickel, copper, brass, or chromium-based alloy, and the electrically conductive component may be applied to the engagement elements 160 via electroplating. The electrically conductive component may alternatively be a metallic substrate having locating means for holding the super-hard materials in place during the spray fusing process. As shown in FIG. 10, the electrically conductive component may also be a mesh framework 175, preferably made of metal, used to locate the engagement elements 160 until they are permanently anchored by the application of the binder material through spray fusing.

In another embodiment, the electrically conductive component may be used to attach the engagement elements 160 to the inner surface 161 by heating within an oven. In a particular embodiment, the base material 103 is aluminum, the engagement elements 160 are diamond dust, and the electrically conductive component is brass. A layer of brass is placed on the inner surface 161, then the engagement elements 160 are placed on the inner surface 161 and heated in an oven at, for example 2200–2800° F.

In initially fixing the material to the inner surface 161 before spray fusing, a high-temperature adhesive may be utilized instead of welding or heating within an oven. Before applying the engagement elements 160 to the inner surface 161, the high-temperature adhesive is preferably applied to the engagement elements 160 using a syringe, but in the alternative, the hard or super-hard material may be coated with the high-temperature adhesive prior to affixing the hard or super-hard material to the inner surface 161. As an alternate method of using the adhesive to attach the engagement elements 160 to the inner surface 161, the high temperature adhesive may be applied or coated, for example through brushing, onto the inner surface 161, and the engagement elements 160 may be subsequently applied to the adhesive-coated inner surface 161. After attaching the engagement elements 160 to the inner surface 161 with the high-temperature adhesive, spray fusing with a binder material may be utilized to permanently anchor the engagement elements 160 to the inner surface 161. The high-temperature adhesive may be alumina-based. Preferably, the high-temperature adhesive has the consistency of paint or paste and is a curing adhesive.

In an alternate method of attaching the engagement elements 160, in the form of small shaped particles, to the inner surface 161, the engagement elements 160 may be held within a mesh framework 175, as shown in FIG. 10. The mesh framework 175 may be fixed to the inner surface 161 through use of a high-temperature adhesive having characteristics as described above. Alternatively, the mesh framework 175 may be made of a suitable alloy that allows it to be readily spot welded to the inner surface 161. The engagement elements 160 are held in location in the mesh framework 175 by the aid of a corresponding geometry to the mesh spaces. It is also contemplated to coat the engagement elements 160 with an electrically conductive component (see above) prior to insertion within the mesh framework 175 to more securely fix the engagement elements 160 to the mesh framework 175 for subsequent spray fusing of the binder material. The mesh framework 175 advantageously maintains suitable spacing between the engagement elements 160. In a further embodiment, the mesh framework 175 may be placed over the top or on the outside of the engagement elements 160 and then removed after the spray fusing process has taken place.

An additional method may be utilized to obtain the gripping member 150 of FIGS. 8–9 which involves attaching hard or super-hard materials in the form of engagement elements 160 to the inner surface 161 by brazing. Generally, brazing involves soldering the super-hard materials to the base material 103 using a hard solder with a high melting point. Other methods of attaching the engagement elements 160 to the inner surface 161 include, but are not limited to, flame-spraying ceramic at the engagement elements 160 (preferably when the engagement elements 160 are diamond dust) while the engagement elements 160 are located on the inner surface 161 (preferably aluminum), as well as fixing the engagement elements 160 to the inner surface 161 merely by welding, shrink-fitting, or electroplating, which methods are known by those skilled in the art, without the spray fusing thereafter as described above.

Referring again to FIGS. 8–9, another method for attaching the engagement elements 160 to the inner surface 161 is powdered metallurgy or sintering, which is a process generally known to those skilled in the art. Sintering involves placing the engagement elements 160 (preferably diamond dust), which may be powdered, into a mold in the ultimately desired locations. Next, the metal base material 103, in powdered form, is packed into the mold above the engagement elements 160. Pressure and heat is applied to the mixture, causing diffusionary bonding between the metal materials. The gripping member 150 results, wherein the engagement elements 160 are located on the inner surface 161 usually in a similar pattern to the initial pattern placed into the mold. The advantage of sintering is that even when the pattern of engagement elements 160 on the inner surface 161 is non-homogeneous, the constituents stay generally in place through the process.

In a yet further alternate method for attaching the engagement elements 160 to the inner surface 161, a jet may be utilized to blow gases at very high speeds towards the inner surface 161, and the engagement elements 160 may be introduced into the gas stream. Typically, a speed in the region of Mach 2 is used. The kinetic energy of the procedure is converted to thermal energy which welds the engagement elements 160 to the inner surface 161.

An alternate method for attaching the engagement elements 160 to the inner surface 161 involves placing the engagement elements 160 within a mold and thereafter pouring the material used to make the base material 103, e.g. aluminum, in molten form into the mold, so that the engagement elements 160 are set in the base material 103 upon cooling.

The present invention is not limited to the order in which the steps of affixing the engagement elements 160 to the inner surface 161 and inserting the gripping member 150 into the housing 119 and the gripping apparatus (not shown) are performed. The engagement elements 160 may be attached to the inner surface 161 prior to insertion of the gripping member 150 into the gripping apparatus. It is equally contemplated that the engagement elements 160 may be attached to the inner surface 161 after the insert 101 (or the insert 1) is located within the gripping apparatus.

In use, the gripping member 150 is formed by attaching the engagement elements 160 to a surface of the base material 103 which will be used to grippingly engage the object 102. In FIGS. 8–11, the inner surface 161 is used to grippingly engage the object 102; however, it is contemplated for use with a spear or similar gripping apparatus to place the engagement elements 160 onto the outer surface 121 of the base material 103. The engagement elements 160 may be attached to the base material 103 by any of the methods described above. Then, the gripping member 150 is made into an arcuate shape so that it will fit within the cavity 120 by the methods described above. These two steps may be performed in opposite order also, so that the engagement elements 160 are attached to the base material 103 after its formation into an arcuate shape.

Next, the gripping member 150 is inserted into the cavity 120. A previous gripping member may thus be rapidly replaced by inserting the gripping member 150 into the insert housing 119 and the gripping apparatus. Next, the object 102 is inserted into the gripping apparatus, and the gripping apparatus grippingly engages and may rotate and/or translate the object 102 in the usual manner, depending upon the type of gripping apparatus utilized.

In all of the above embodiments, the inserts 1, 101 may be utilized in any gripping apparatus, including a tong, spider, elevator, or a gripping head such as a torque head or spear. When using the inserts 1, 101 in a spear, the engagement elements 160 would not be on the inner surface 161 of the base material 103, but on the outer surface 121, as a spear grips from the inside of the tubular body. The cavity 20, 120 in the insert housing 19, 119 would similarly face outward rather than inward in the spear or similar gripping apparatus.

In any of the above embodiments, any number of inserts 1, 101 may be inserted in the gripping apparatus or clamping device for placement around the object 2, 102 to simplify the arrangement of the inserts 1, 101 and to facilitate gripping of the object 2, 102. The inserts 1, 101 allow for easy replacement in tongs, spiders, elevators, gripping heads, and other apparatus when the need for exchange of the inserts 1, 101 arises. In this manner, two, three, or more inserts 1, 101 may form a generally circular hole through which the object 2, 102 may be inserted. Each insert 1, 101 only partially surrounds the gripped object 2, 102 so that multiple inserts 1, 101 are arranged around the object 2, 102 for holding it along its circumference (see FIGS. 2 and 11). Within the gripping apparatus, one or more inserts 1 may be combined with one or more inserts 101 to envelope the object 2, 102. Furthermore, the inserts 1, 101 are not limited to forming a circular pattern within the gripping apparatus, but may also form a rectangular or square pattern to grip a rectangular pipe, for example, or may form any other shape. In use within a gripping apparatus, any of the above embodiments may be arranged within an adaptor to form a generally circular hole for object 2, 102 insertion. The inserts 1, 101 may also be stacked on top of one another longitudinally along a length of a tubular body to increase gripping power.

While the foregoing is directed to embodiments of the present invention, other and further embodiments of the invention may be devised without departing from the basic scope thereof, and the scope thereof is determined by the claims that follow.

The invention claimed is:

1. An insert for a tubular gripping apparatus comprising:

a malleable or elastomeric base material configured to be inserted into the gripping apparatus; and a plurality of strip-like, blade-like, or bar-like, arcuate gripping elements at least partially embedded in the base material to form a tubular gripping surface.

2. The insert of claim 1, wherein the base material is arcuate.

3. The insert of claim 2, wherein a curvature of each gripping element substantially corresponds to a curvature of the base material.

4. The insert of claim 1, wherein the plurality of gripping elements are substantially parallel to one another.

5. The insert of claim 4, wherein the plurality of gripping elements are arranged substantially transverse to a longitudinal axis of the insert.

6. The insert of claim 4, wherein the plurality of gripping elements are arranged relative to the longitudinal axis of the insert at an angle of between about 50° and 130°.

7. The insert of claim 1, wherein the plurality of gripping elements are arranged relative to a longitudinal axis of the insert at an angle of between about 70° and 110°.

8. The insert of claim 1, wherein the plurality of gripping elements are arranged relative to a longitudinal axis of the insert at an angle of between about 85° and 95°.

9. The insert of claim 1, wherein the base material is an elastomeric lining.

10. The insert of claim 1, wherein the gripping surface of each gripping element is substantially flush with a surface of the base material.

11. The insert of claim 1, wherein the gripping surface protrudes from a surface of the base material.

12. The insert of claim 1, wherein each gripping element a gripping surface having engagement elements.

13. The insert of claim 12, wherein the engagement elements are grain or particle-like, and are made of at least one material selected from the group consisting of: titanium, diamond, glass, ceramic, corundum, and quartz.

14. The insert of claim 12, wherein the engagement elements are teeth.

15. The insert of claim 14, wherein all of the teeth have the same depth and angles of leading and trailing faces.

16. The insert of claim 14, wherein the teeth form rows of interlaced teeth.

17. The insert of claim 1, wherein each of the gripping elements has a wave-like curvature in its lengthwise direction.

18. The insert of claim 1, wherein the insert further comprises a housing, and the base material is at feast partially disposed within the housing.

19. The insert of claim 18, wherein the housing is an arcuate member forming a concave cavity and the base material is at least partially disposed within the cavity.

20. The insert of claim 19, wherein the housing comprises a back wall and two side walls forming the cavity and a plurality of ribs arranged on a surface of the back wall and protruding from the back wall surface, and the base material is disposed on the back wall surface.

21. The insert of claim 20, wherein the ribs are generally inclined with respect to a lengthwise direction of the gripping elements.

22. The insert of claim 21, wherein the ribs and the gripping elements are arranged substantially perpendicular to each other.

23. The insert of claim 20, wherein the housing comprises first and second walls limiting the cavity, the first and second walls being located on opposite sides of the insert and releasably attached to the back wall.

24. The insert of claim 23, wherein the first and second walls are top and bottom walls, respectively.

25. The insert of claim 1, wherein the bass material is a cylindrical segment and a curvature of the base material substantially corresponds to a curvature of the gripping elements.

26. The insert of claim 25, wherein a lengthwise direction of each of the gripping elements is offset from an arc of the base material by an angle less than or equal to about 40° and greater than or equal to −40°.

27. The insert of claim 26, wherein the offset angle is less than or equal to about 20° and greater than or equal to −20°.

28. The insert of claim 27, wherein the offset angle is less than or equal to about 5° and greater than or equal to −5°.

29. The insert of claim 25, wherein a lengthwise direction of each of the gripping elements is aligned with an are of the base material.

30. The insert of claim 1, wherein the base material is fabricated from a group of materials consisting of: aluminum, copper alloy, brass alloy, and alloys thereof.

31. The insert of claim 1, wherein the base material is a malleable metal having a hardness less than a hardness of steel.

32. The insert of claim 1, wherein the gripping elements are made from a hard material.

33. The insert of claim 32, wherein the hard material is a metal.

34. An insert for a tubular gripping apparatus, comprising:

a base material having a gripping surface, wherein the base material is a malleable metal; and a plurality of engagement elements attached to the gripping surface, the engagement elements capable of grippingly engaging an outer surface of a tubular, wherein the engagement elements comprise grains or particles of hard material, wherein the base material has a thickness substantially greater than a maximum dimension of each engagement element to compensate for deviations in the outer surface of the tubular.

35. The insert of claim 34, wherein the base material is fabricated from a group of materials consisting of: aluminum, copper alloy, brass alloy, and alloys thereof.

36. The insert of claim 34, wherein the hard material is diamond dust.

37. The insert of claim 34, wherein the hard material is one or more of silicon, zircon, tungsten carbide, carborundum, cubic boron nitride, glass, ceramic, quartz, thermally stable product, and titanium.

38. The insert of claim 34, wherein the insert only partially surrounds the tubular, and a second insert is arranged around the tubular for grippingly engaging the outer surface of the tubular.

39. The insert of claim 34, further comprising a housing for releasably holding the base material at least partially therein.

40. The insert of claim 39, wherein the housing is an arcuate member having a concave cavity therein for releasably holding the base material.

41. The insert of claim 40, wherein the cavity is formed by at least a back wall and two side walls, and a plurality of ribs protrudes toward the base material and are arranged on the back wall for releasably holding the base material at least partially within the cavity.

42. The insert of claim 41, wherein the base material comprises a plurality of ribs on a surface contacting the back wall of the housing, the ribs of the base material arranged substantially perpendicular to the ribs on the back walk.

43. The insert of claim 41, wherein the housing comprises first and second walls forming the cavity, the first and second walls being located on opposite sides of the insert and releasably fixed to the back wall.

44. The insert of claim 43, wherein the first and second walls are top and bottom walls, respectively.

45. The insert of claim 34, wherein the malleable metal has a hardness less than a hardness of steel.

46. The insert of claim 34, wherein the base material is curved into an arcuate shape which substantially corresponds to the outer surface of the tubular.

47. A method of grippingly engaging a tubular, comprising:

providing an insert, the insert comprising:

a malleable or elastomeric base material configured to be inserted into a gripping apparatus; and a plurality of strip-like, blade-like, or bar-like, curved gripping elements at least partially embedded in the base material to form a tubular gripping surface, wherein a curvature of each of the gripping elements substantially corresponds to a curvature of the tubular;

inserting the insert into the gripping apparatus; and grippingly engaging the tubular with the gripping surface to impart translational force or torque into the tubular.

48. The method of claim 47, wherein the gripping apparatus is a tong.

49. The method of claim 47, wherein the gripping apparatus is a spider.

50. The method of claim 47, wherein the gripping apparatus is a torque head.

51. The method of claim 47, wherein the gripping apparatus is a spear.

52. The method of claim 47, wherein the gripping apparatus is an elevator.

53. The method of claim 47, wherein each gripping element has a gripping surface having engagement elements and the engagement elements comprise one or more of diamond dust, silicon, zircon, tungsten carbide, carborundum, cubic boron nitride, glass, ceramic, quartz, thermally stable product, and titanium.

54. The method of claim 47, wherein the base material comprises a malleable metal having a hardness less than a hardness of steel.

55. An insert for a tubular gripping apparatus, comprising:

a housing having:

back and side walls forming a cavity, and a plurality of longitudinally extending ribs formed on a surface of the back wall and protruding from the surface;

a malleable or elastomeric base material disposed on the surface and having a hardness less than a hardness of steel; and engagement elements attached to a gripping surface of the base material, the engagement elements comprising particles or grains of material.

56. The gripping apparatus of claim 55, wherein the material of the engagement elements comprises one or more of diamond dust, silicon, zircon, tungsten carbide, carborundum, cubic boron nitride, glass, ceramic, quartz, thermally stable product, and titanium.

57. The gripping apparatus of claim 55, wherein the base material comprises one or more of one or more of aluminum, copper alloy, or brass alloy.

58. An insert for a gripping apparatus for conducting translational force or torque into a moveable tubular object comprising;

a malleable base material configured to be inserted into the gripping apparatus; and a plurality of gripping elements at least partially embedded in the base material to form an object gripping surface, wherein:

each gripping element has engagement elements on its gripping surface, the engagement elements define a plurality of teeth, and the plurality of teeth form rows of interlaced teeth.

59. An insert for a gripping apparatus for conducting translational force or torque into a moveable tubular object comprising;

a malleable base material configured to be inserted into the gripping apparatus;

a plurality of gripping elements at least partially embedded in the base material to form an object gripping surface; and a housing for releasably holding the base material with the gripping elements, wherein:

the housing is an arcuate member forming a concave cavity on an inner surface for receiving the base material with the gripping elements, and the housing comprises top and bottom walls limiting the cavity, the top and bottom walls being releasably attached to the back wall.

60. An insert for a gripping apparatus for conducting translational force or torque into a tubular object, comprising:

a base material having an arcuate shape and a gripping surface corresponding to a circumference of the tubular object; and a plurality of engagement elements attached to the gripping surface, the engagement elements capable of grippingly engaging the circumference of the tubular object; and a housing for releasably holding the base material at least partially therein, wherein:

the engagement elements comprise grains or particles of material, the housing is an arcuate member comprising a concave cavity therein for releasably holding the base material, the cavity is formed by at least a back wall and two side walls, a plurality of ribs protrude toward the base material and are arranged on the back wall for releasably holding the base material at least partially within the cavity, and the housing further comprises top and bottom walls forming the cavity, the top and bottom walls being releasably fixed to the back wall.

61. An insert for a tubular gripping apparatus comprising:

a malleable or elastomeric base material configured to be inserted into the gripping apparatus; and a plurality of arcuate gripping elements at least partially embedded in the base material to form a tubular gripping surface, wherein:

each gripping element has a gripping surface having engagement elements, the engagement elements are teeth, and the teeth form rows of interlaced teeth.

62. An insert for a tubular gripping apparatus comprising:

a malleable or elastomeric base material configured to be inserted into the gripping apparatus; and a plurality of arcuate gripping elements at least partially embedded in the base material to form a tubular gripping surface, wherein;

the insert further comprises a housing, the base material is at least partially disposed within the housing, the housing is an arcuate member forming a concave cavity, the base material is at least partially disposed within the cavity, the housing comprises a back wall and two side walls forming the cavity and a plurality of ribs arranged on a surface of the back wall and protruding from the back wall surface, and the base material is disposed on the back wall surface.

63. The insert of claim 62, wherein the ribs are generally inclined with respect to a lengthwise direction of the gripping elements.

64. The insert of claim 63, wherein the ribs and the gripping elements are arranged substantially perpendicular to each other.

65. An insert for a tubular gripping apparatus comprising:

a malleable or elastomeric base material configured to be inserted into the gripping apparatus; and a plurality of arcuate gripping elements at least partially embedded in the base material to form a tubular gripping surface, wherein:

the insert further comprises a housing, the base material is at least partially disposed within the housing, the housing is an arcuate member forming a concave cavity, and the base material is at least partially disposed within the cavity, the housing comprises first and second walls limiting the cavity and a back wall, the first and second walls being located on opposite sides of the insert and releasably attached to the back wall.

66. The insert of claim 65, wherein the first and second walls are top and bottom walls, respectively.

67. An insert for a tubular gripping apparatus comprising:

a malleable or elastomeric base material configured to be inserted into the gripping apparatus; and a plurality of arcuate gripping elements at least partially embedded in the base material to form a tubular gripping surface, wherein:

the base material is a cylindrical segment and a curvature of the base material substantially corresponds to a curvature of the gripping elements and a lengthwise direction of each of the gripping elements is offset from an are of the base material by an angle less than or equal to about 40° and greater than or equal to −40°.

68. The insert of claim 67, wherein the offset angle is less than or equal to about 20° and greater than or equal to −20°.

69. The insert of claim 68, wherein the offset angle is less than or equal to about 5° and greater than or equal to −5°.

70. An insert for a tubular gripping apparatus, comprising:

a base material having a gripping surface, wherein the base material is a malleable metal;

a plurality of engagement elements attached to the gripping surface, the engagement elements capable of grippingly engaging an outer surface of a tubular, wherein the engagement elements comprise grains or particles of hard material; and a housing for releasably holding the base material at least partially therein, wherein:

the housing is an arcuate member having a concave cavity therein for releasably holding the base material, the cavity is formed by at least a back wall and two side walls, and a plurality of ribs protrudes toward the base material and are arranged on the back wail for releasably holding the base material at least partially within the cavity, the housing comprises first and second walls forming the cavity, the first and second walls being located on opposite sides of the insert and releasably fixed to the back wall.

71. The insert of claim 70, wherein the first and second walls are top and bottom walls, respectively.

* * * * *

UNITED STATES PATENT AND TRADEMARK OFFICE

CERTIFICATE OF CORRECTION

PATENT NO. : 7,231,984 B2
APPLICATION NO. : 10/787846
DATED : June 19, 2007
INVENTOR(S) : Manfred Jaensch It is certified that error appears in the above-identified patent and that said Letters Patent is hereby corrected as shown below:

<u>In the Claims section</u>:

Column 15, Claim 12, line 30, after "element", please insert --has--.

Column 15, Claim 18, line 46, please delete [feast] and insert --least--.

Column 16, Claim 25, line 1, please delete [bass] and insert --base--.

Column 16, Claim 42, line 65, please delete [walk] and insert --wall--.

Column 17, Claim 58, line 65, after "comprising", please delete the semicolon [;] and insert a colon --:--.

Column 18, Claim 59, line 11, after "comprising", please delete the semicolon [;] and insert a colon --:--.

Column 20, Claim 67, line 7, between "elements" and "and", please insert a comma --,--.

Column 20, Claim 70, line 34, please delete [wail] and insert --wall--.

Signed and Sealed this

First Day of April, 2008

JON W. DUDAS
*Director of the United States Patent and Trademark Office*